US005156418A

United States Patent [19]

Kelly

[11] Patent Number: 5,156,418

[45] Date of Patent: Oct. 20, 1992

[54] SKI BOOT SCRAPER

[76] Inventor: Peter F. Kelly, 797 Princess Street, Kingston, Ontario K7L 1G1, Canada

[21] Appl. No.: 689,549

[22] Filed: Apr. 23, 1991

[51] Int. Cl.[5] ..... A63C 11/00

[52] U.S. Cl. ..... 280/813; 280/816

[58] Field of Search ..... 280/601, 605, 813, 809, 280/816, 164.2

[56] References Cited

U.S. PATENT DOCUMENTS

| | | | |
|---|---|---|---|
| 3,826,518 | 7/1974 | Hennig | 280/813 |
| 3,975,036 | 8/1976 | Glenn | 280/813 |
| 3,999,773 | 12/1976 | Shuttleworth | 280/813 |
| 4,227,714 | 10/1980 | Riedel | 280/605 |
| 5,042,839 | 8/1991 | Liari | 280/813 |

*Primary Examiner*—Andres Kashnikow
*Assistant Examiner*—Richard Camby
*Attorney, Agent, or Firm*—Dickstein, Shapiro & Morin

[57] ABSTRACT

There is provided a new and useful ski boot scraper comprising a scraper element for mounting on an alpine ski forward of a ski binding toe piece and moveable between an extended operative position and a retracted rest position; a control unit for mounting on an alpine ski between the toe and heel pieces of a ski binding and moveable between an extended operative position and a retracted rest position; connecting structure extending between the scraper element and the control unit for moving the scraper element or the control unit between the extended and the retracted positions responsive to corresponding movement of the control unit or the scraper element between the extended and the retracted positions; and a biasing member for biasing at least one of the control unit and the scraper element into the extended position.

26 Claims, 3 Drawing Sheets

SKI BOOT SCRAPER

FIELD OF THE INVENTION

This application relates to ski boot scrapers for mounting on alpine or downhill skis.

BACKGROUND OF THE INVENTION

A problem which arises continuously in the sport known as alpine or downhill skiing is that of snow caking on and sticking to the bottom and edges of ski boots. Almost any time a skier walks on snow in ski boots, whether in getting up after a fall or prior to or after completing a ski run, snow and possibly other refuse will have been found to have compressed and stuck to the bottom of the ski boot. This material must be removed before putting the skis on again for reasons of comfort and safety. The boot simply will not fit properly into the binding when there is a build up of snow under the bottom or on the heel and toe edges of the boot. This will interfere with proper boot release, affect boot to friction pad interaction and so generally create a hazard for the skier.

It is therefore necessary to scrape the snow and other refuse off of the bottom of the boot. This is frequently done by drawing the boot across the toe piece of the binding.

This procedure has several disadvantages. A certain amount of the snow scraped off of the boot bottom in this manner simply falls rearwardly of the toe piece to land on the ski and still interfere with the placing of the boot in the binding. As well, the scraping of the boot over the binding may affect the adjustment of the binding thus affecting safety. Further, other material trapped in the snow on the bottom of the boot may find its way into the binding mechanism and again affect safety.

A further method of removing snow from boot bottoms is by banging one boot against the other. This is particularly unsatisfactory once one boot has been placed on the ski, since banging the free boot against the mounted boot may then knock the mounted boot out of the binding. Further, this method does not in any event ensure adequate removal of material from the boot.

Where the snow is fairly tightly compacted on the bottom of the boot, it may be necessary to utilize the end of a ski pole, or the fingers, to scrape or dig away the compacted snow. This is a very awkward and so unsatisfactory procedure.

There is therefore a very widely felt need for a convenient and satisfactory means of removing snow from a ski boot sole prior to placing the boot in the binding of a ski.

The present invention provides a ski boot scraper which is intended to alleviate the problems discussed above.

PRIOR ART

Hennig U.S. Pat. No. 3,826,518, issued Jul. 30, 1974, and Shuttleworth U.S. Pat. No. 3,999,773, issued Dec. 28, 1976, illustrate fixed boot scrapers for mounting on a ski forwardly of a ski binding toe piece.

Glenn U.S. Pat. No. 3,975,036, issued Aug. 17, 1976, provides a boot scraper which is also for mounting on a ski forwardly of a binding toe piece or rearwardly of a binding heel piece. A ski pole is used to lock and unlock a pivoting scraper blade.

Riedel U.S. Pat. No. 4,227,714, issued Oct. 14, 1980, deals with ski brakes rather than with boot scrapers and is typical of ski brakes which are held in a retracted position by a ski boot in a binding but are biased toward an extended position when the ski boot is removed from the binding.

None of the prior art known to the applicant provides structure or method which is similar to the present invention.

SUMMARY OF THE INVENTION

A ski boot scraper has now been devised which utilizes a retractable scraper blade which is controlled by a control unit placed on the ski between the toe and heel pieces of a ski binding and which is responsive to the placing of a ski boot in the binding to control extension or retraction of the scraper blade.

Thus, the invention provides a ski boot scraper comprising a scraper element for mounting on an alpine ski forward of a toe piece or rearward of a heel piece of a ski binding and moveable between an extended operative position and a retracted rest position; a control unit for mounting on an alpine ski between the toe and heel pieces of a ski binding and moveable between a extended operative position and a retracted rest position; connecting means extending between the scraper element and the control unit for moving the scraper element or the control unit between the extended and the retracted positions responsive to corresponding movement of the control unit or the scraper element between the extended and the retracted positions; and biasing means for biasing at least one of the control unit and the scraper element into the extended position.

The scraper may be integrated into a unit with the toe or heel piece.

BRIEF DESCRIPTION OF THE DRAWINGS

In drawings which illustrate embodiments of the invention.

Figure 1:
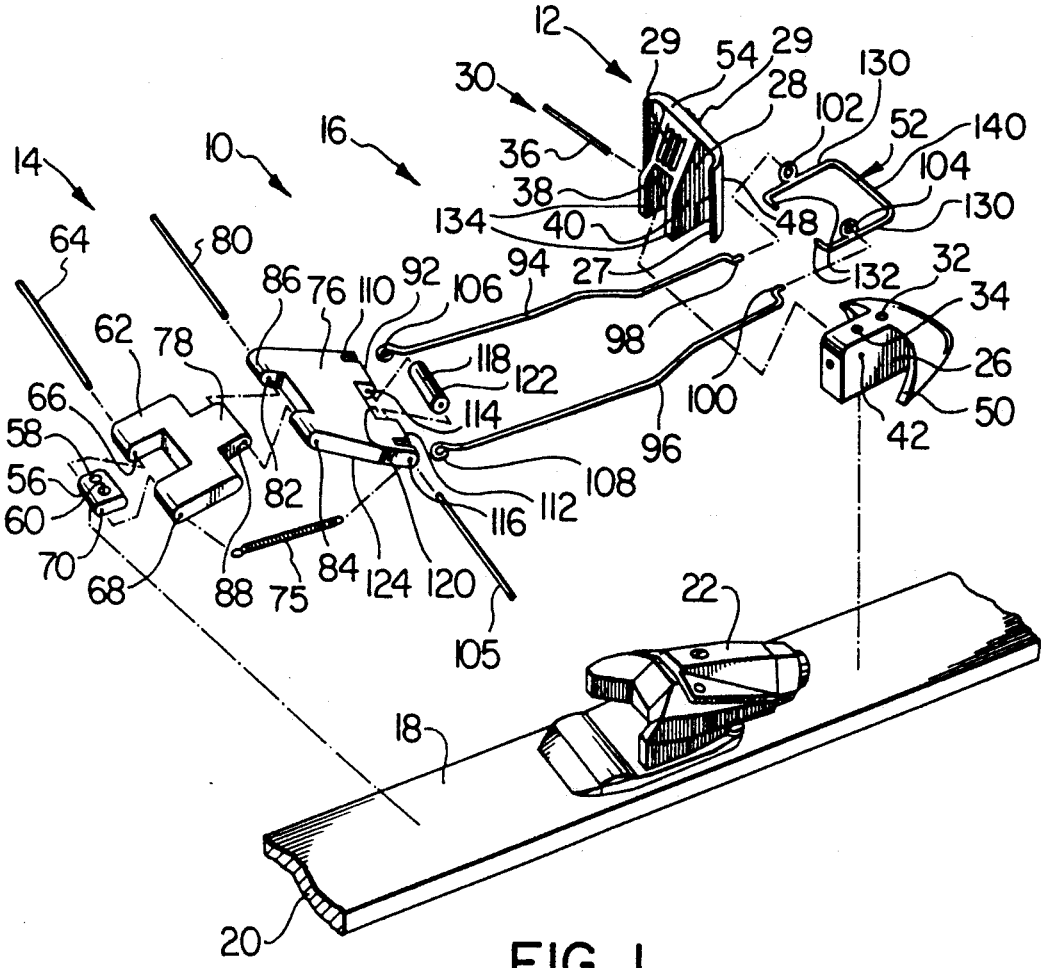
FIG. 1 is an exploded view of one embodiment of a boot scraper according to the invention.

While the invention will be described in conjunction with illustrated embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The ski boot scraper lo comprises a scraper element 12 and a control unit 14 joined by connecting means 16.

The boot scraper 10 is intended for mounting on the upper surface 18 of an alpine or downhill ski 20 with the scraper element 12 mounted forward of the toe piece 22 or rearward of heel piece 24 of a ski binding and the control unit 14 mounted between toe piece 22 and a corresponding heel piece 24. In the preferred configuration scraper element 12 is mounted forward of the piece 22.

The scraper element 12 comprises a scraper base member 26 and a scraper blade 28, together with means 30 for joining the two together. The scraper base member 26 is adapted to be secured to the surface 18 of ski 20 as by means of screws through holes 32 and 34.

The scraper blade 28 is mounted for rotation relative to scraper base member 26 by means of a pivot pin 36 passing through holes 38 and 40 in scraper blade 28 and hole 42 in scraper base member 26.

Figure 2:
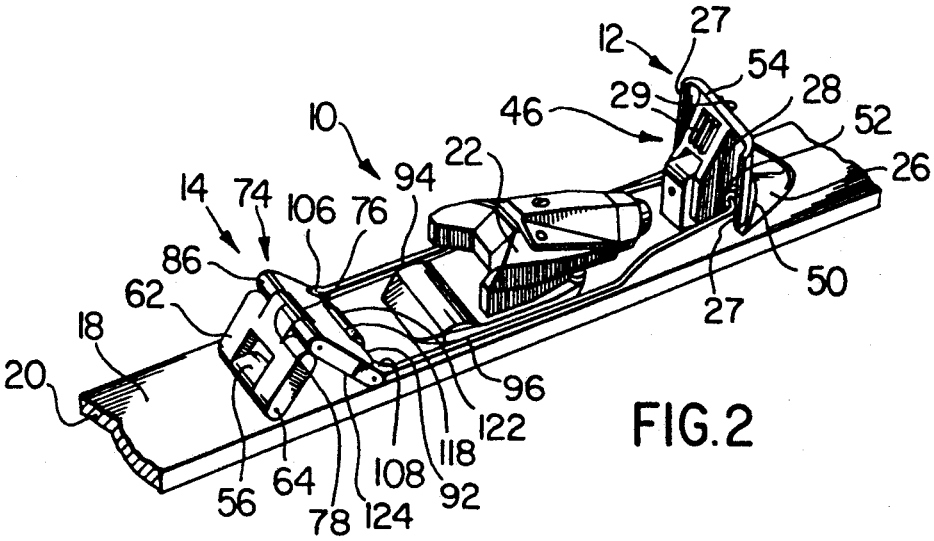
FIG. 2 is a perspective view of the apparatus of FIGURE 1 mounted on a ski.
Figure 3:
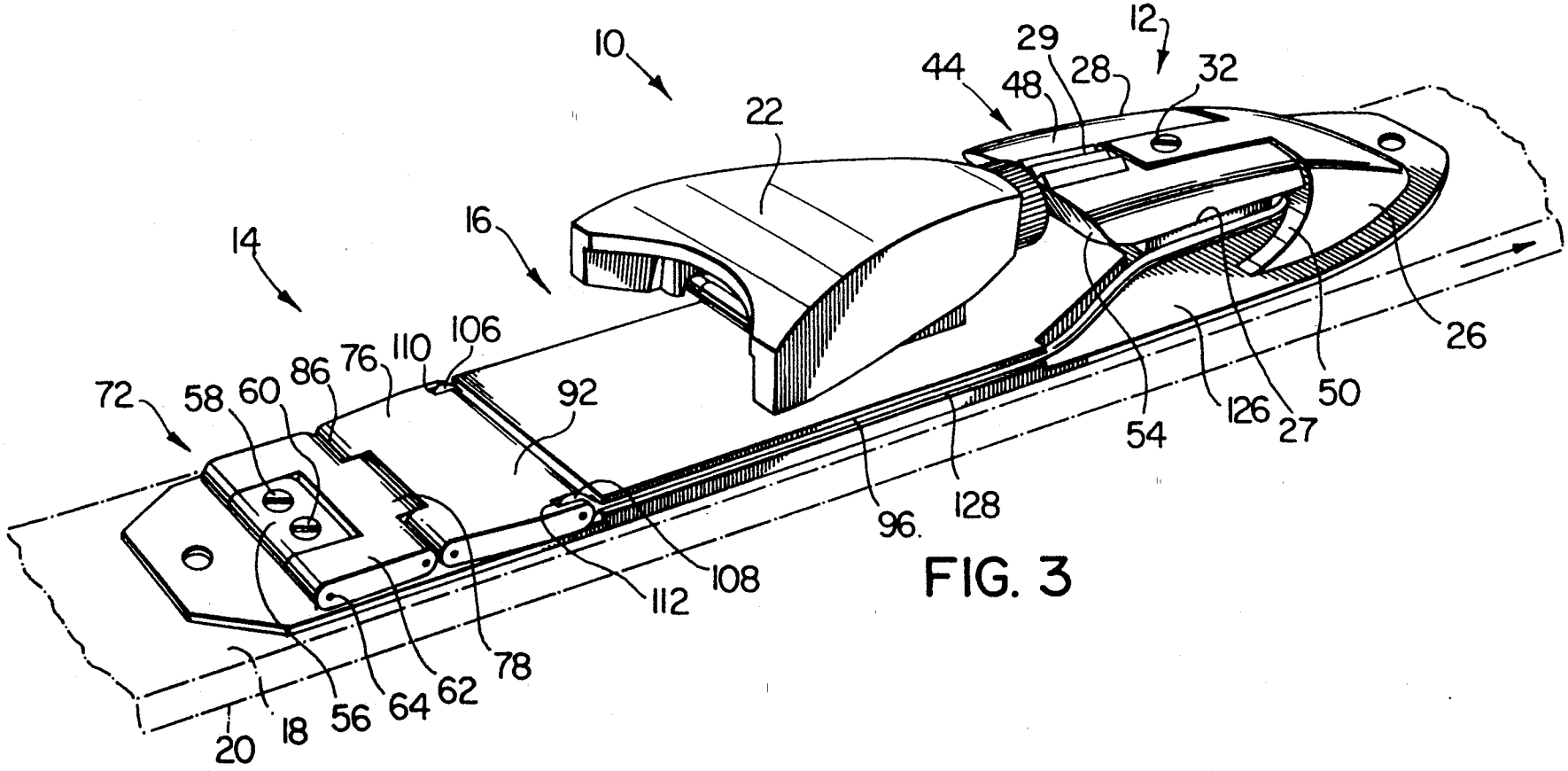
FIG. 3 illustrates a further embodiment of the invention in the retracted position.

The scraper blade 28 is thus rotatable between a first retracted position 44, as illustrated in FIG. 3, in which the scraper element 12 forms a low aerodynamic unit; and an extended position 46, as illustrated in FIG. 2.

A limiting means is provided to limit the degree of rotation of the blade 28. That means of limiting rotation may comprise the upper surface 48 of blade 28 bringing up against the rearward edge 50 of base member 26.

In the preferred case the scraper blade 28 is biased into the extended position 46 by spring member 52.

The scraper blade 28 may take various suitable configurations. It is preferred, however, that the edge extremity 54 be relatively thin and oriented transversely of ski 20 to provide the actual scraping edge for the boot sole. It is also preferred that outer edges 27 be in the form of thin scraping edges which will be substantially perpendicular to the surface 18 of ski 20 when blade 28 is extended. Further, it is preferred that the blade 28 incorporate forward and rearward scraping areas, preferably upstanding ridges 29, for scraping the edges and sides of the boot sole.

The control unit 14 comprises a control unit base member 56 which is adapted to be secured to the upper surface 18 of ski 20 by means of screws or the like fasteners inserted through holes 58 and 60. A control unit activation member 62 is rotatably attached to base member 56 by means of a pivot pin 64 extending through holes 66 and 68 in member 62 and hole 70 in member 56.

The activation member 62 is thus rotatable relative to base member 56 from a retracted position 72, as illustrated in FIG. 3, substantially flat against the upper surface 18 of ski 20; and an extended position 74, as illustrated in FIG. 2, extending outwardly of surface 18. Activation member 62 is preferably spring biased into said extended position by spring 75.

In the preferred case a connecting plate 76 is rotatably connected to the end 78 of activation member 62 remote from base member 56. A pin 80 extends through holes 82 and 84 in one end 86 of connecting plate 76 and through hole 88 in the end 78 of activation member 62.

The connecting plate 76 is freely rotatable about pin 80, so that the second end 92 of connecting plate 76 is free to remain adjacent the upper surface 18 of ski 20 when activation member 62 is in the extended position 74.

Connecting means 16 preferably provides a pair of elongated members 94 and 96 which extend between and are rotatably connected to scraper element 12 and control unit 14. In the most preferred case the members 94 and 96 are steel wires.

Elongated members 94 and 96 are preferably connected to scraper element 12 by direct connection to spring member 52. Thus, the hooked ends 98 and 100 respectively engage loops 102 and 104 provided for the purpose integral with spring member 52.

The elongated members 94 and 96 are preferably connected to the end 92 of connecting plate 76 by means of a pivot pin 105. The looped ends 106 and 108 on the rearward ends of members 94 and 96 respectively fit into slots 110 and 112 provided for the purpose in the end 92 of plate 76. Pin 105 extends through holes 114 and 116 in the end 92 of plate 76.

There is also preferably provided a free rolling member 118 also on pin 105 and partially within the slot 120 in the end 92 of connecting plate 76. The extremity 122 of the rolling member 118 protrudes slightly beyond the surface, in particular the lower surface 124 of connecting plate 76.

The elongated members 94 and 96 are profiled to pass around the outside of the toe piece 22.

The connecting means 16 is joined in such a way that either of the control unit 14 or the scraper element 12 is responsive to the spring bias of the other so that the scraper blade 28 and the activation member 62 are either both in the extended position or both in the retracted position. Either blade 28 or member 62 may be spring biased, but it is preferable that both are spring biased. Thus, in operation, when there is no ski boot in the binding on ski 20, the spring bias on either or both of scraper blade 28 and activation member 62 forces those parts into the extended position illustrated in FIG. 2. In this position the spring bias holds the scraper blade 28 against the rotation limiting means to allow a ski boot bottom to be drawn across the edge extremity 54 of scraper blade 28 to remove any snow or refuse which may have compacted against the boot sole bottom or sides. The boot is then in conventional manner placed in the binding first with the front of the boot within the toe piece 22 and then with the heel of the boot in the heel piece 24. When the heel of the boot is moved down into the heel piece the bottom of the boot forces the activation member 62 substantially flat against the upper surface of the ski 20. This in turn causes the end 92 of connecting plate 76 to move forwardly along the surface of the ski. Correspondingly the attached elongated members 94 and 96 are forced forwardly thus causing the scraper blade 28 to rotate into the retracted position illustrated in FIG. 3.

The hooked ends 132 of spring member 52 are inserted for rotation into the holes 134 provided in the scraper blade 28.

Figure 4:
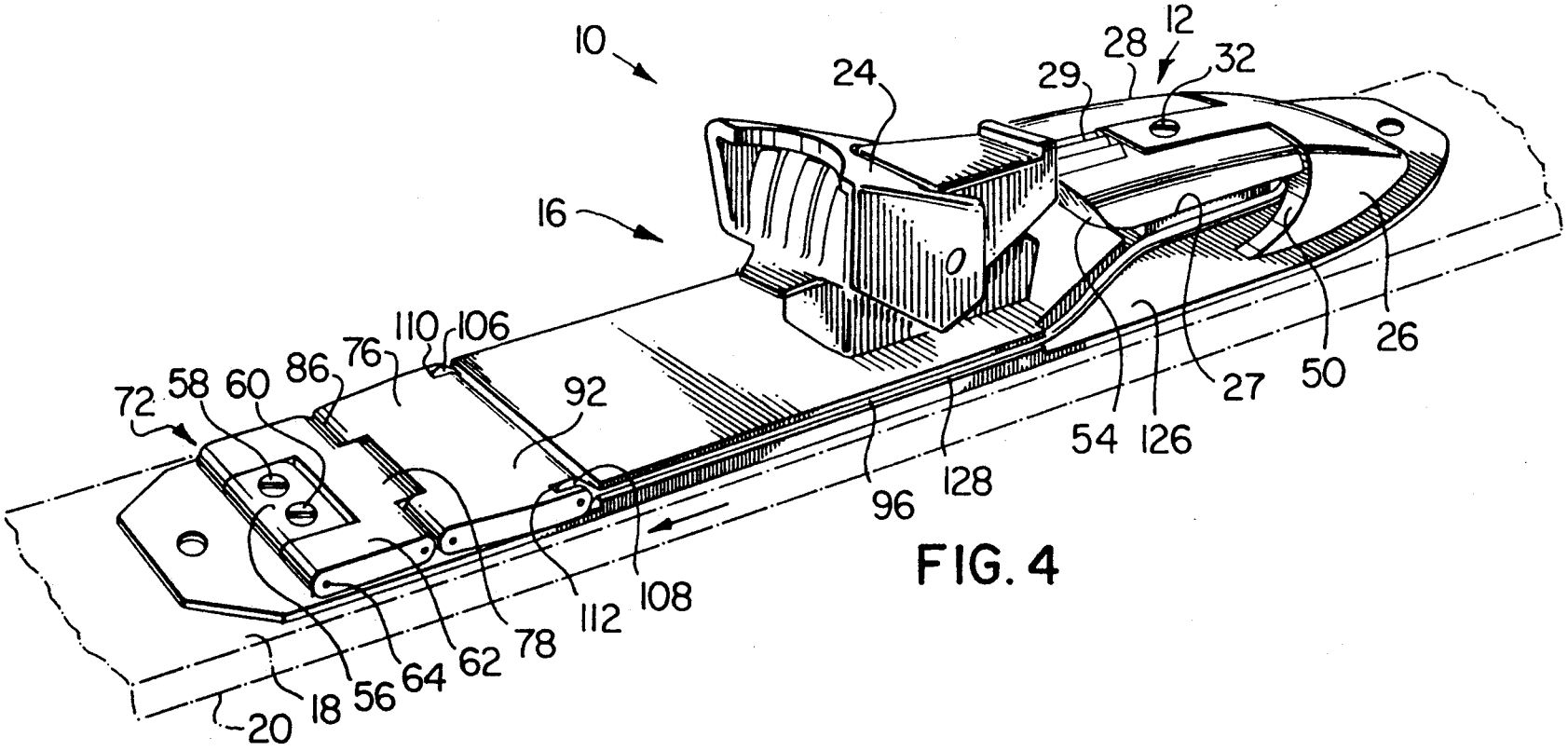
FIG. 4 illustrates a further embodiment of the invention in the retracted position.

When the control unit 14 is depressed as illustrated in FIG. 4, the elongated members 94 and 96 are projected forwardly and spring member 52 moves forward under base member 26.

When the skier steps out of the binding, the stress is released and the spring member 52 then springs back to its original position, causing the scraper blade 28 to extend, as illustrated in FIG. 2.

It is noted that the roller member 118 is optionally included to ensure smooth movement of the end 92 of connecting plate 76 along the upper surface 18 of ski 20.

In a preferred embodiment, as illustrated in FIG. 3, the boot scraper 10 is integral with or at least mounted on a common base plate 126 with the toe piece 22 to form an integral unit for mounting on the ski surface 18. The base plate 126 is preferably provided with a groove or covered passageway 128 on each side of plate 126 to receive the elongated members 94 and 96 in a sliding relationship.

FIG. 4 illustrates a unit similar to FIG. 3 but in which scraper element 12 is mounted rearward of heel piece 24. The scraper element operates in the same way as in FIG. 3 but with certain directions of movement reversed.

Thus it is apparent that there has been provided in accordance with the invention a ski boot scraper that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. A ski boot scraper comprising:

a scraper element for mounting on an alpine ski at one of a position forward of a toe piece and a position rearward of a heel piece, of a ski binding and moveable between an extended operative position and a retracted rest position;

a control unit for mounting on an alpine ski between the toe and heel pieces of a ski binding and moveable between an extended operative position and a retracted rest position;

connecting means extending between said scraper element and said control unit for moving one of said scraper element and said control unit between said extended and said retracted positions responsive to corresponding movement of the other one of said control unit and said scraper element between said extended and said retracted positions; and biasing means for biasing at least one of said control unit and said scraper element into said extended position.

2. The boot scraper of claim 1 wherein said scraper element is mounted forward of said toe piece.

3. The boot scraper of claim 1 wherein said control unit is biased into said extended position.

4. The boot scraper of claim 1 wherein said scraper element comprises a scraper base member for securing to said ski and a scraper blade hingedly connected to said scraper base member, said blade moveable between said retracted and said extended positions.

5. The boot scraper of claim 4 wherein said scraper blade includes along an extremity thereof a relatively thin scraping edge which is oriented transverse to the length of said ski when said element is mounted on a ski.

6. The boot scraper of claim 5 wherein said scraper blade includes a relatively thin scraping edge which is substantially perpendicular to a top surface of said ski when said blade is in the extended position.

7. The boot scraper of claim 5 wherein said blade includes, adjacent the extremity thereof, a raised scraping area on at least one of forward and rearward sides of said blade when said blade is in said extended position.

8. The boot scraper of claim 7 wherein said at least one scraping area comprises a series of upstanding ridges oriented substantially perpendicular to the surface of said ski when said blade is in the extended position.

9. The boot scraper of claim 4 wherein said scraper element includes limiting means for limiting the amount of rotation of said scraper blade about said hinge.

10. The boot scraper of claim 9 wherein said limiting means comprises a raised part of said scraper base member.

11. The boot scraper of claim 4 wherein said means for biasing biases said scraper blade into said extended position.

12. The boot scraper of claim 11 wherein said means for biasing comprises spring means.

13. The boot scraper of claim 4 wherein said control unit comprises a control unit base member for securing to said ski and a control unit activation member hingedly connected to said unit base member for movement between said retracted and said extended positions.

14. The boot scraper of claim 13 wherein said activation member is spring biased toward said extended position.

15. The boot scraper of claim 4 wherein said connecting means comprises a pair of arms for positioning parallel to and immediately adjacent to the top surface of said ski, one to each side of and below the level of the top of a base plate of a toe piece of a ski binding.

16. The boot scraper of claim 15 wherein said control unit further comprises a connecting plate hingedly connected at one end to said activation plate and at an opposite end to said connecting means whereby when said activation plate is moved between said extended and retracted positions, said opposite end of said connecting means is moved substantially longitudinally of and parallel to said ski.

17. The boot scraper of claim 1 wherein said scraper is integral with a toe piece of a ski binding.

18. The boot scraper of claim 1 wherein said scraper element and a toe piece of a ski binding are mounted on a common base plate.

19. The boot scraper of claim wherein said scraper is integral with a heel piece of a ski binding.

20. The boot scraper of claim 1 wherein said scraper element and a heel piece of a ski binding area mounted on a common base plate.

21. The boot scraper of claim 18 wherein said base plate includes longitudinal edges having guide means for said pair of arms of said connecting means.

22. The boot scraper of claim 20 wherein said base plate includes longitudinal edges having guide means for said pair of arms of said connecting means.

23. The boot scraper of claim 21 wherein said guide means are grooves.

24. The boot scraper of claim 21 wherein said guide means are enclosed passages.

25. The boot scraper of claim 22 wherein said guide means are grooves.

26. The boot scraper of claim 22 wherein said guide means are enclosed passages.

* * * * *